US006554541B1

(12) United States Patent
Antonsen

(10) Patent No.: US 6,554,541 B1
(45) Date of Patent: Apr. 29, 2003

(54) METHOD AND DEVICE ADAPTED FOR USE IN THE PLACING OF A SUCTION ANCHOR WITH AN ATTACHED ANCHOR CHAIN OR SIMILAR ON THE OCEAN BED

(75) Inventor: Pål Espen Antonsen, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/936,159

(22) PCT Filed: Mar. 6, 2000

(86) PCT No.: PCT/NO00/00080

§ 371 (c)(1),
(2), (4) Date: Mar. 5, 2002

(87) PCT Pub. No.: WO00/56598

PCT Pub. Date: Sep. 28, 2000

(30) Foreign Application Priority Data

Mar. 11, 1999 (NO) ..... 19991182

(51) Int. Cl.[7] ..... E02D 5/62
(52) U.S. Cl. ..... 405/224.1; 405/224
(58) Field of Search ..... 405/172, 158, 405/184.4, 224.1, 224

(56) References Cited

U.S. PATENT DOCUMENTS 4,676,696 A * 6/1987 Laursen ..... 166/338
4,717,287 A * 1/1988 Laursen ..... 166/341
4,869,615 A * 9/1989 Galle ..... 285/321
5,807,027 A * 9/1998 Ostergaard ..... 166/338
6,196,757 B1 * 3/2001 Bakke ..... 403/322.3

* cited by examiner

*Primary Examiner*—Thomas B. Will
*Assistant Examiner*—Lisa M. Saldano
(74) *Attorney, Agent, or Firm*—Michael D. McCully

(57) ABSTRACT

A method and a device for use in the placing of a suction anchor (1) with an attached anchor chain (2) on the ocean bed. The suction anchor (1) and the anchor chain (2) are to be lowered separately to the ocean bed, and be connected at the ocean bed without any use, worth mentioning, of mechanically movable parts or closing mechanisms, the process is to take place by means of gravity and in as few operations and with as few pieces of expensive utility equipment as possible. This is done in that the suction anchor (1) and the anchor chain (2) are connected by means of a guiding element (6) with a lower locking element (7) arranged thereto, and a connecting element (3). The connecting element (3) is positioned at the lower end of the anchor chain (2) and adapted for insertion into the guiding and locking elements (6, 7). The guiding and locking elements (6, 7) are positioned on the side wall (12) of the suction anchor. The connecting takes place in that the connecting element (3) is lowered into the guiding and locking elements (6, 7) first. Then the upper end of the connecting element (3) is pulled outwards from the suction anchor (1), so that the connecting element (3) is brought into a position in which the longitudinal axis of the connecting element (3) is concentric with the longitudinal axis of the bore (9) of the locking element. The operation is completed in that the connecting element (3) is pulled outwards from the suction anchor (1) along the direction of the longitudinal axis of the bore (9) of the locking element, until the locking piece (4) of the connecting element (3) engages the locking element (7).

19 Claims, 9 Drawing Sheets

Figure 1:
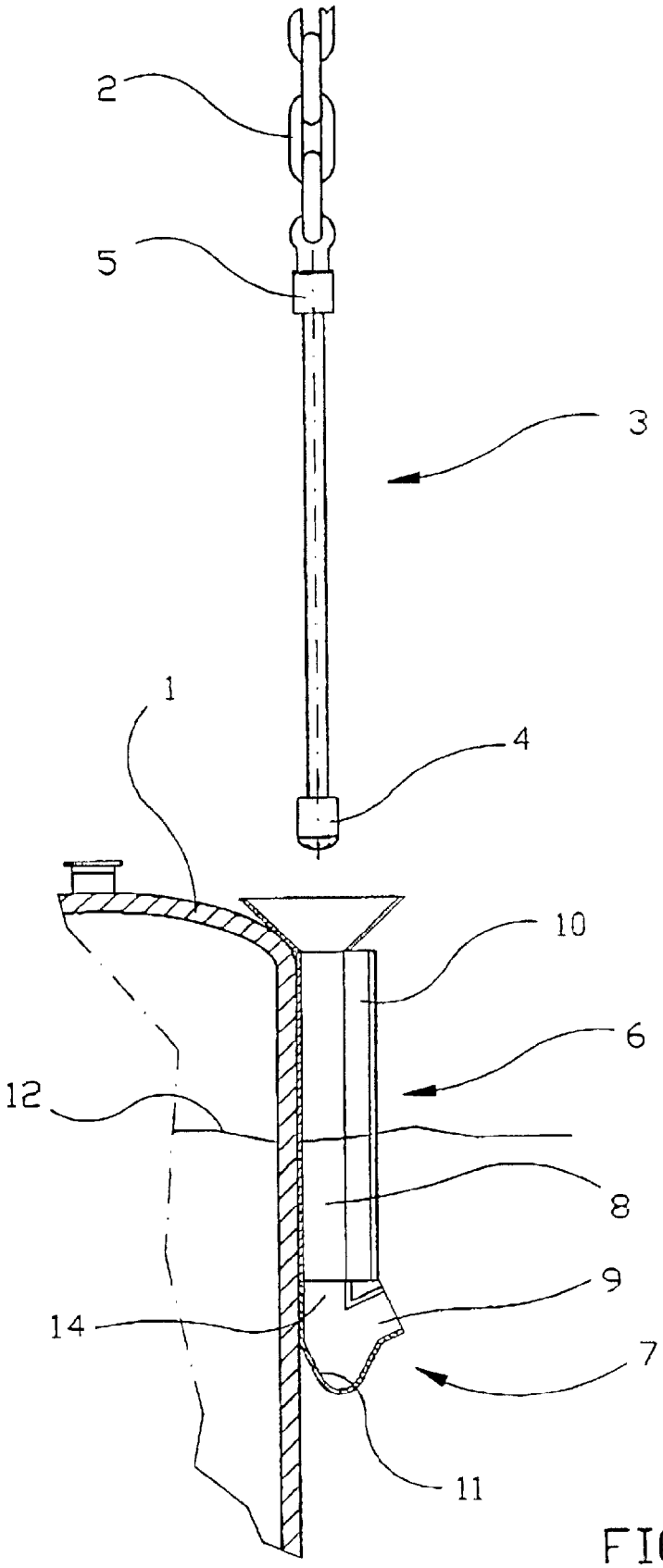

METHOD AND DEVICE ADAPTED FOR USE IN THE PLACING OF A SUCTION ANCHOR WITH AN ATTACHED ANCHOR CHAIN OR SIMILAR ON THE OCEAN BED

The invention relates to a method and a device adapted for s, use in the placing of a suction anchor with an attached anchor chain or similar on the ocean bed, said suction anchor being lowered first without the anchor chain, and secured by suction to the ocean bed, after which the lower end of the anchor chain is lowered and connected to the suction anchor.

Suction anchors with associated anchor chains are used when floating installations of different kind are to be anchored to the ocean bed. Earlier it was common for the suction anchor and the associated anchor chain to be transported off shore and lowered to the ocean bed collectively. This resulted in very high costs since the suction anchor and the associated anchor chain have a great weight, often more than a thousand tons, and take up a lot of space, so that large surface vessels and heavy crane equipment were needed. The costs were reduced somewhat through the gradual change to transporting and lowering of the suction anchor and anchor chain separately. This involves reduced costs with respect to the surface vessel and crane equipment, but it has turned out that the reduction is balanced, to a large extent, by new costs that did not accrue when the suction anchor and the anchor chain were transported and lowered collectively. Of such costs may be mentioned that it will be necessary to provide a submarine vehicle with the equipment necessary for the connection of the suction anchor and the anchor chain on the ocean bed, that a far more complex device must be provided for connecting the suction anchor and the anchor. chain than when the connection is carried out before the lowering, that the work takes more time, etc. Another important drawback is that the known devices for connecting the suction anchor and the anchor chain on the ocean bed, are highly complicated constructions that give rise to many faults and delays during the connection.

The main object of the present invention is to provide a method and a device of the above type, wherein the suction anchor and the anchor chain are lowered to the ocean bed separately, and wherein the connecting of the suction anchor and the anchor chain can be carried out without the use of an expensive submarine vehicle performing the actual connecting. Other objectives are that the connecting is to take place without any use, worth mentioning, of mechanically movable parts or closing mechanisms, that the connecting shall be carried out without faults and by means of gravity, and in as few operations and otherwise with as few pieces of expensive utility equipment as possible.

As appears from the characterizing part of the present independent claim concerning the above method, this is realized by connecting the suction anchor and the lower end of the anchor chain in the following steps:

i) the lower end of the anchor chain is lowered into a vertically extending guiding element with a lower locking element arranged thereto, the guiding and locking elements being provided externally on the side wall of the suction anchor and formed with a bore each, arranged so that the longitudinal axes form an acute angle between themselves, and the lower end of the anchor chain has a preferably rod-like connecting element arranged thereto;

ii) the upper end of the connecting element is pulled outwards from the suction anchor, so that the connecting element is brought into a position, in which the longitudinal axis of the connecting element is concentric with the longitudinal axis of the bore of the locking element; and iii) the connecting element is pulled outwards from the suction anchor in the direction along the longitudinal axis of the bore of the locking element until the lower end of the connecting element engages the locking element of the suction anchor, the lower end of the connecting element being formed as a locking piece with a cross-sectional shape adapted to the bore of the locking element.

As appears from the characterizing part of the present independent claim concerning the above device, through the connection of the suction anchor and the anchor chain, by means of a vertically extending guiding element provided with a lower locking element and a preferably rod-like connecting element, the connecting element being adapted for insertion into the guiding and locking elements and engagement with the locking element; through the provision of the guiding and locking elements externally on the side wall of the suction anchor, and their configuration with a bore each, arranged so that the longitudinal axes form an acute angle between themselves, and through the positioning of the connecting element on the lower end of the anchor chain and its configuration with a lower locking piece, the locking piece being of a cross-sectional shape adapted to the cross-sectional shape of the bore of the locking element. Other advantageous features of the invention appear from the present dependent claims and otherwise from the specification.

Figure 2:
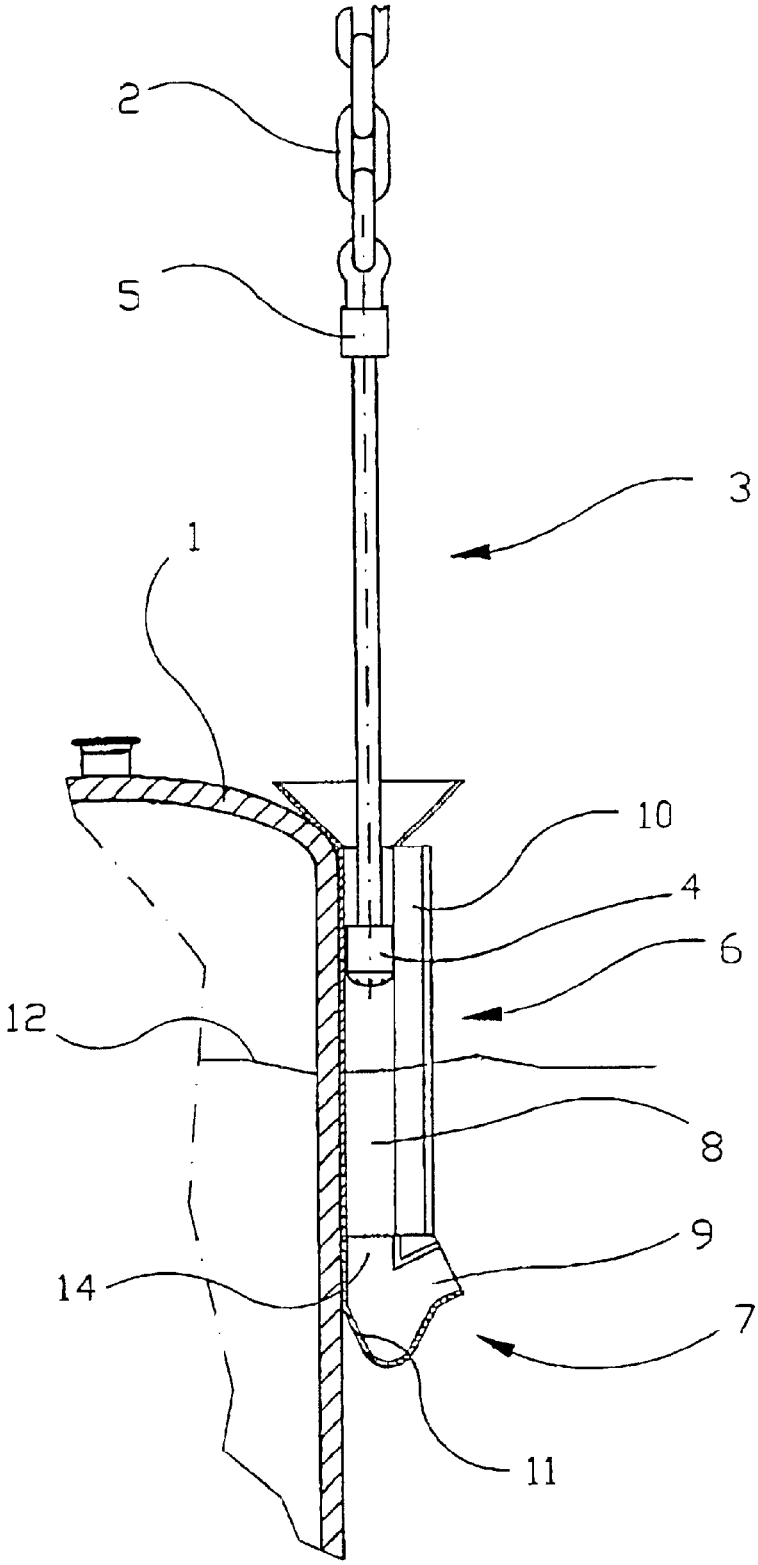
Figure 3:
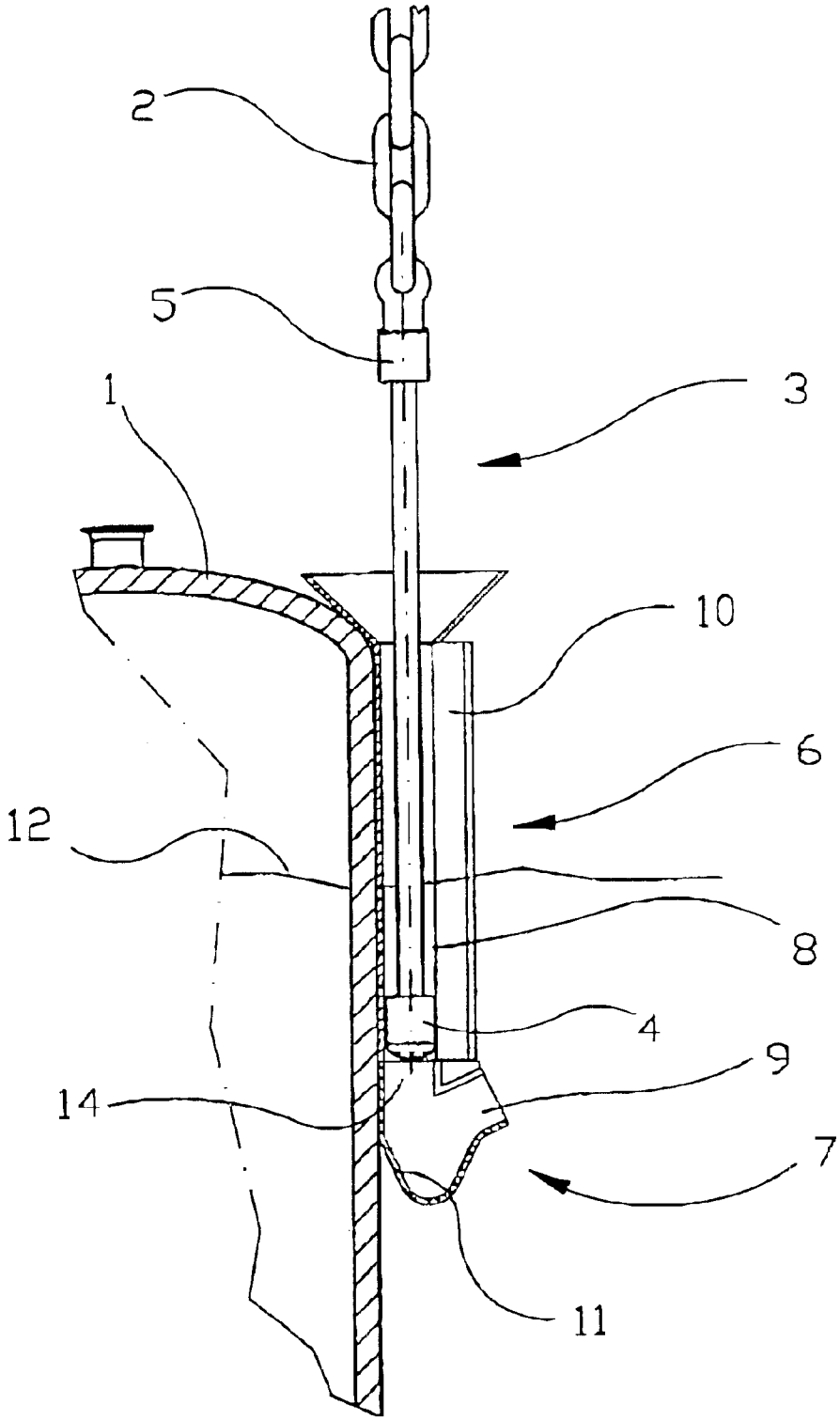
Figure 4:
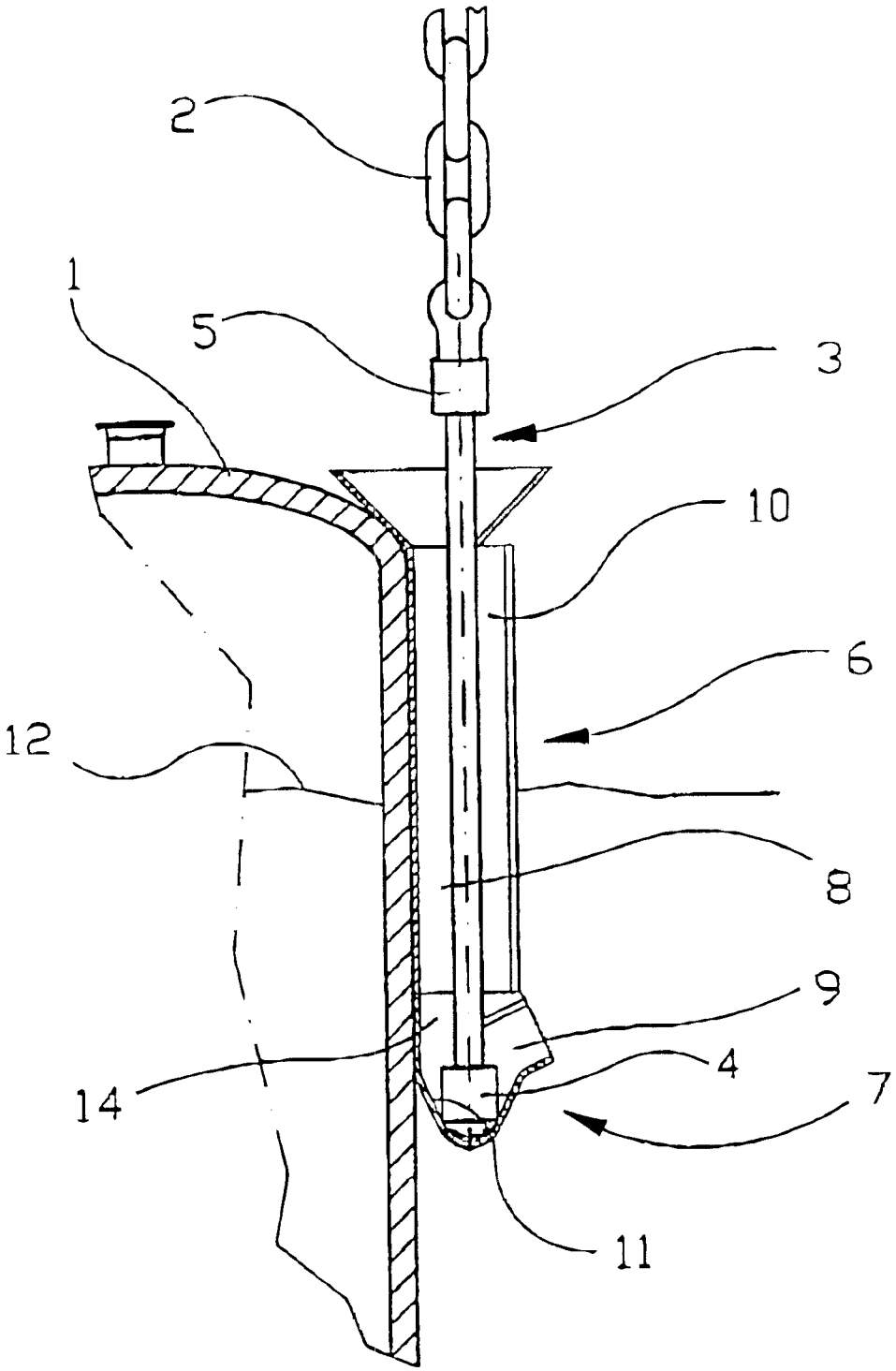
Figure 5:
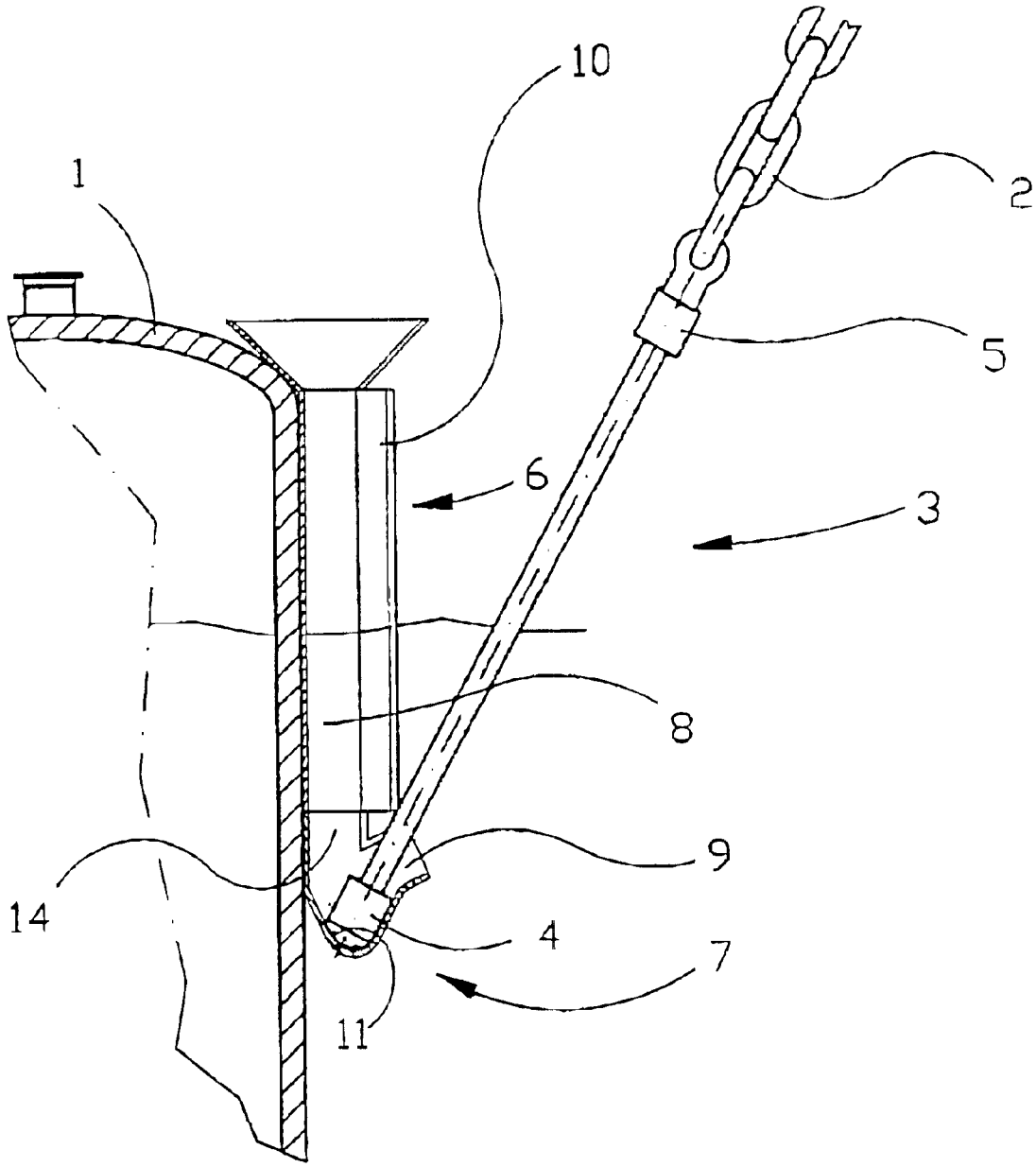
Figure 6:
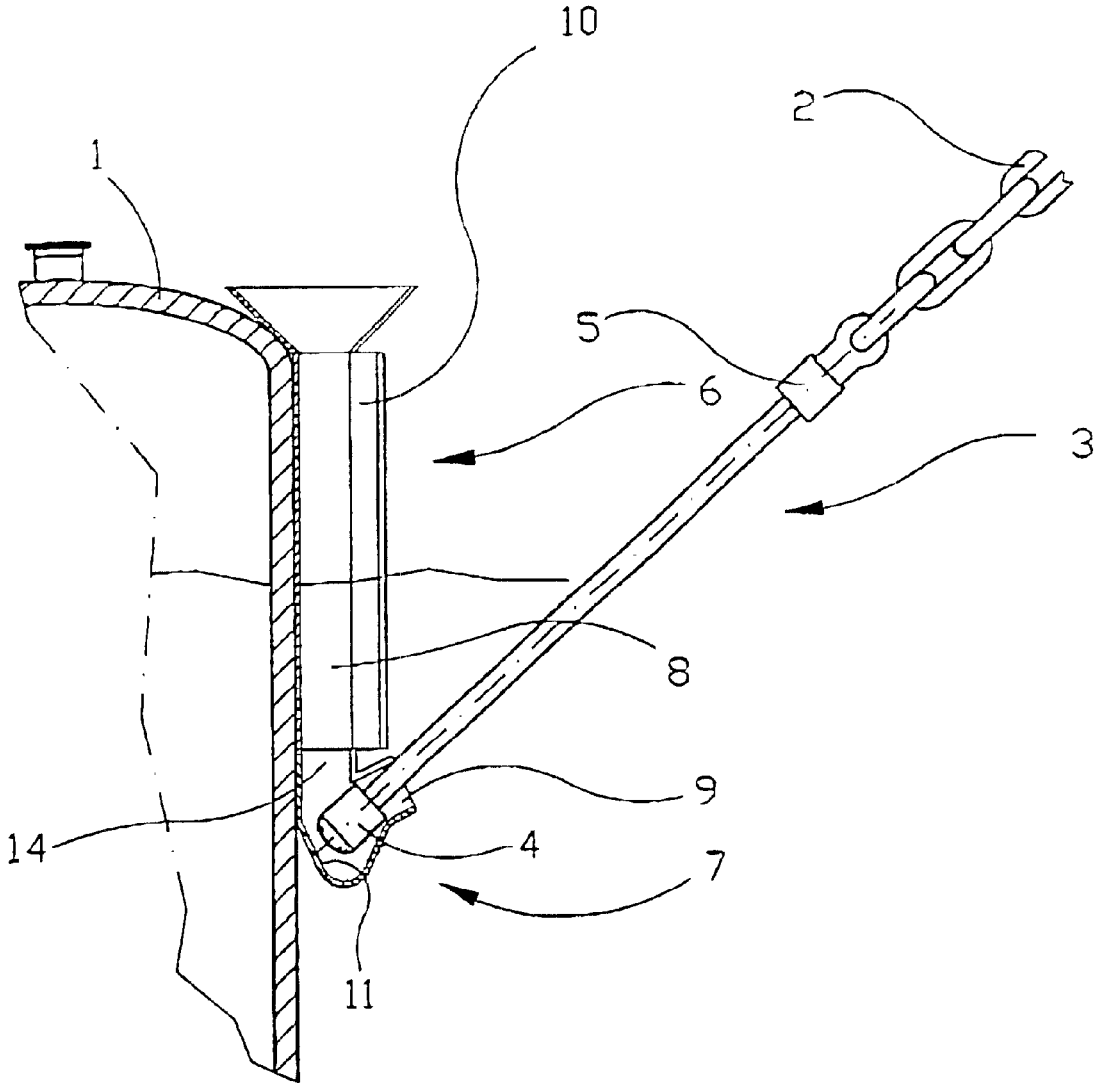
Figure 7:
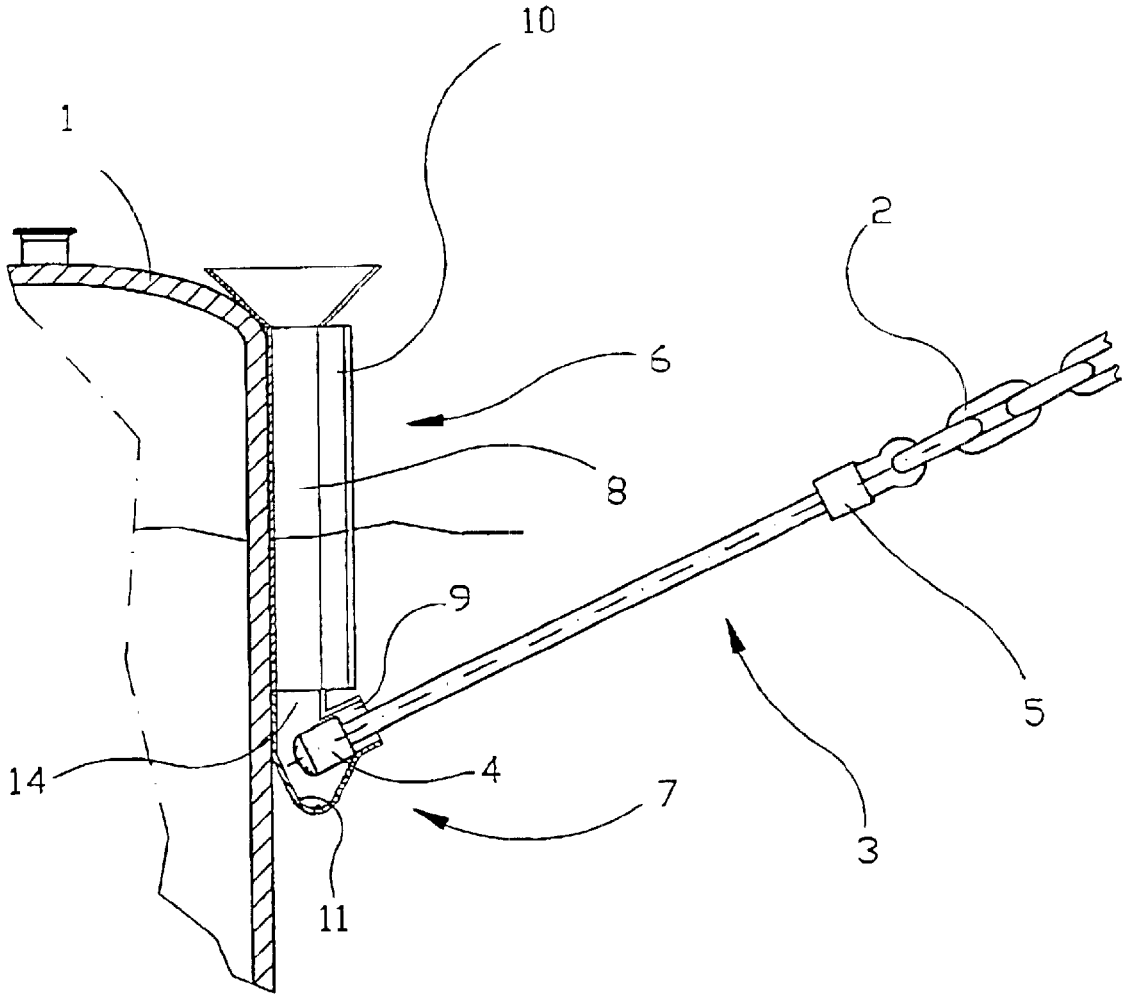
Figure 8:
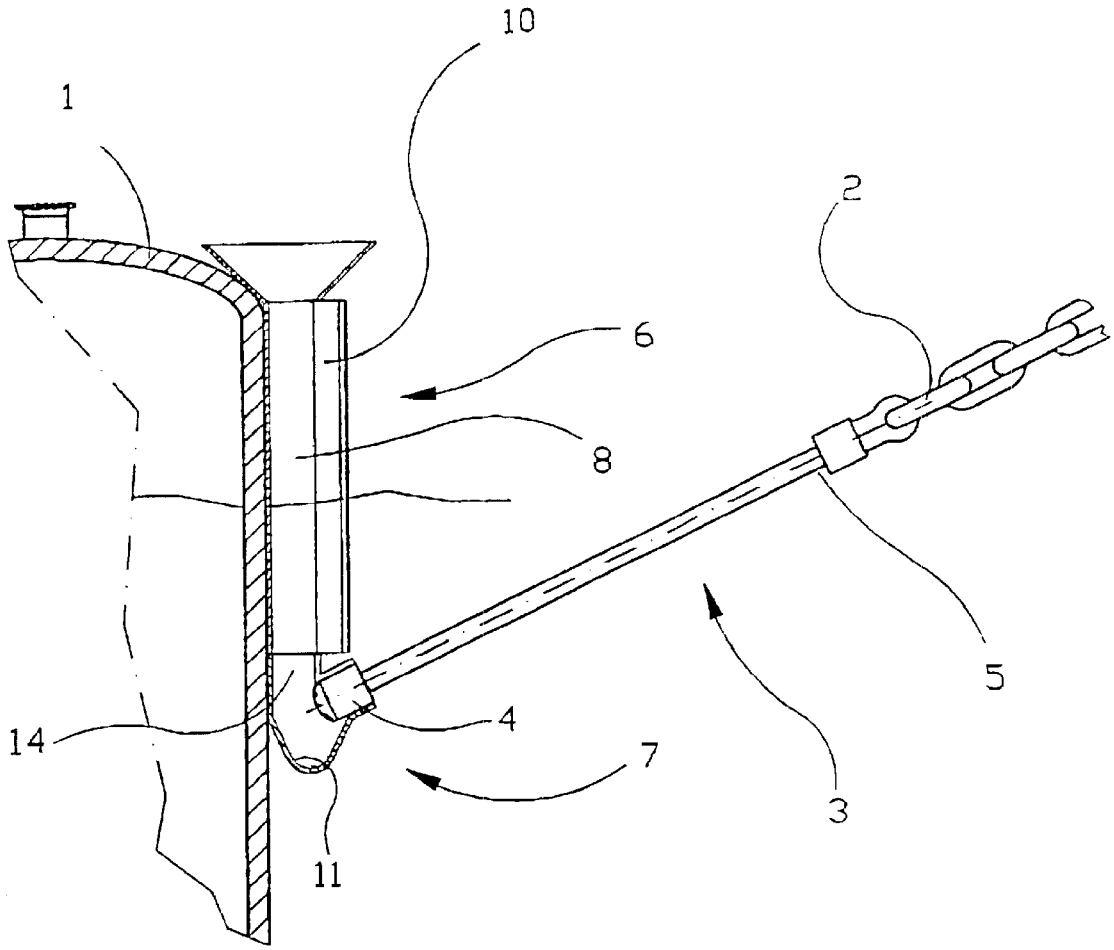
Figure 9:
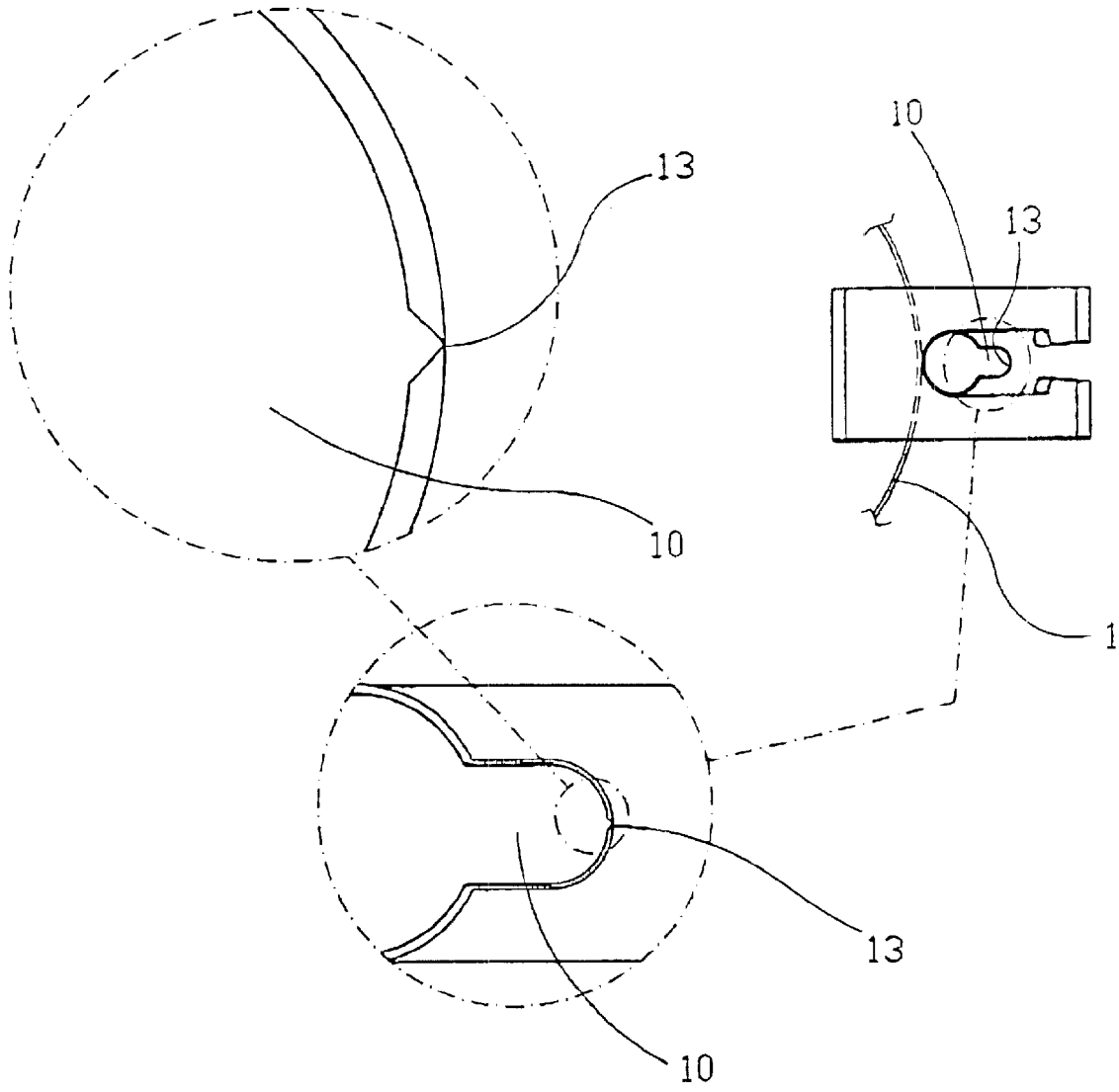

In the following part of the specification and with reference to the set of figures, an embodiment of the invention will be explained, FIG. 1 showing a schematic section of a vertical section through the present suction anchor and anchor chain. As shown, the suction anchor is equipped with an upper guiding element and a lower locking element, and the anchor chain with a lower connecting element. The suction anchor has earlier been lowered and secured by suction to the ocean bed. The anchor chain, on the other hand, has been lowered into a position, in which the connecting element hangs above the guiding and locking elements prior to connection;

FIGS. 2–3 showing the same section as that in FIG. 1, apart from the connection having been initiated, and the connecting element having been lowered into the guiding and locking elements;

FIG. 4 showing the same section as that in FIG. 1, except that additionally the connecting element has been lowered through a recess of the locking element, and the connecting element has been pushed laterally outwards and into a slit in the guiding element by means of a locking piece at the lower end of the connecting element and a guide surface of the recess of the locking element;

FIGS. 5–7 showing the same section as that in FIG. 1, except that the upper end of the connecting element is pulled laterally outwards from the suction anchor, or is pulled into a position, in which the longitudinal axis of the connecting element is concentric with a longitudinal axis of a bore of the locking element;

FIG. 8 showing the same section as that in FIG. 1, except that the connecting element is pulled out in the direction along the longitudinal axis of the bore of the locking element, so that the locking piece of the connecting element is brought into engagement with the bore of the locking element; and FIG. 9 showing a sectional view of a horizontal section, with enlarged details, through the suction anchor and the guiding element.

The present invention relates to a suction anchor 1 with an anchor chain 2 or similar arranged thereto. The suction anchor is placed on the ocean bed and is preferably used in the anchoring of floating installations or similar. The necessary number of suction anchors must be adjusted to the respective installation. The positioning on the ocean bed is carried out in that the suction anchor 1 is lowered first from a suitable surface vessel without the associated anchor chain 2, and is secured by suction to the ocean bed. Then the anchor chain 2 is lowered from the vessel until its lower end reaches and is connected to the suction anchor 1. After the connection, provision is normally provided for a lower portion of the anchor chain to be laid on the ocean bed, laterally outwards from the suction anchor 1.

The connection of the suction anchor 1 and the anchor chain 2 is implemented by means of a guiding element 6 of an essentially vertical extent, provided with a lower locking element 7, and a rod-like connecting element 3. The connecting element 3 is adapted for insertion into the guiding and locking elements 6, 7, and is brought into engagement with the locking element 7. The guiding and locking elements 6, 7 are positioned externally on the side wall 12 of the suction anchor, and they are formed with a bore 8, 9 each. The bore 8 of the guiding element extends vertically through the guiding element 6, and it is equipped with an upper funnel-shaped element which is helpful when the connecting element 3 is to be inserted into the guiding element 6. The bore 9 of the locking element extends from a lateral edge of the locking element 7 opposite the bore 8 of the guiding element and slopes towards the bore 8, so that the longitudinal axes of the bores 8, 9 of the guiding and locking elements form an acute angle between themselves. The connecting element 3 may be attached to the lower part of the anchor chain 2 by means of a shackle-like securing means 5, and it is formed with a lower locking piece 4. The locking piece 4 has a cross-sectional shape adapted to the cross-sectional shape of the bore 9 of the locking element, so that the locking piece is brought into engagement with the bore 9 of the locking element during the final stage of the connecting. Further, the locking element 7 is formed with a recess 14 which is adapted so, that the locking piece 4 of the connecting element 3 may be carried from the bore 8 of the guiding element into the bore 9 of the locking element. The recess 14 of the locking element has an extent which makes the bores 8, 9 of the guiding and locking elements connected.

The guiding element 6 is formed with a vertically extending slit 10 associated with the bore 8 of the guiding element. The slit 10 of the guiding element is closed on the side that faces away from the bore 8 of the guiding element, by means of an end piece formed with a vertically extending rupture line 13, e.g. in the form of a V-shaped milling. The locking element 7 is formed with a guide surface 11 adapted so, that in the connecting, the connecting element 3 can be displaced into the slit 10 of the guiding element, or the locking piece 4 may be brought into engagement with the bore 9 of the locking element. The guide surface 11 is positioned adjacent to the recess 14 of the locking element and the bore 9 of the locking element. Further, the guide surface 11 is formed with a first portion sloping downwards, and a second portion sloping upwards, seen in relation to the longitudinal axis of the bore 8 of the guiding element. These are connected to an intermediate rounded portion. The connecting element 3 is displaced into the slit 10 of the guiding element when the locking piece 4 is displaced along and down the former portion of the guide surface 11. The locking piece 4 is brought into engagement with the bore 9 of the locking element when different portions of the locking piece 4 are displaced along different portions of the guide surface 11 or the bore 9 of the locking element.

Coarse particles can cause great damage to the anchor chain, if the lower end at the connecting element 3 comes to be positioned under the ocean bed. This implies that the connecting element 3 should be formed with a length that makes it possible for the anchor chain 2 to be positioned above the ocean bed. The heave of the waves may cause damage during the connecting of the suction anchor 1 and the anchor chain. Such damage can be avoided if a portion of the anchor chain is coiled up and fixed by means of a not shown lashing, which is arranged so that it breaks into pieces by undesirable heave of the waves. Thereby is ensured, that after the lashing has been broken, the coiled up part of the anchor chain may equalize the heave of the waves. Otherwise it is apparent that the anchor chain 2 may be replaced by another suitable mooring means, and be attached to the connecting element 3 in a different manner than by the shown shackle-like securing means 5. Neither is there anything to prevent the funnel at the bore 8 of the guiding element from being provided with a not shown cover or similar, which will prevent the entrance of mass from the ocean bed, but will allow the connecting element 3 to be inserted into the guiding element 6.

The connecting is monitored by a minor and remotely controlled submarine vehicle, not shown, so that i.a. the connecting element 3, hanging down from the lower end of the anchor chain 2, may be manoeuvred in towards the funnel at the upper end of the guiding element 6. Then, when the connecting element 3 is brought into correct position above the funnel, more anchor chain 2 is let out from the surface vessel. Thereby the connecting element 3 is lowered into the bore 8 of the guiding element. During the final stage of its being lowerered into the guiding element 6, the locking piece 4 of the connecting element 3 abuts and is lowered along the first portion of the guide surface 11 of the locking element 7. This entails that the connecting element 3 is passed sideways into the slit 10 of the guiding element. When the lowering has been completed, the upper end of the connecting element 3 is pulled laterally outwards from the suction anchor until the longitudinal axis of the connecting element 3 is in a position concentric with the longitudinal axis of the bore of the locking element 9. This happens in the way that the connecting element 3 is torn out through the end piece of the slit 10 of the guiding element along the rupture line 13. As the upper end of the connecting element 3 is being pulled out, different parts of the locking piece 4 will abut different parts of the guide surface 11 and parts of the bore 9 of the locking element, so that said parts almost act as a rotary joint for the connecting element 3. The connecting ends by the connection element 3 being pulled outwards from the suction anchor 1 in the direction along the longitudinal axis of the bore 9 of the locking element, until the locking piece 4 at the lower end of the connecting element 3 engages the bore 9 of the, locking element. The submarine vehicle may be used to check that the connecting element 3 has reached the bottom inside the guiding and locking elements 6, 7, that the upper end of the connecting element 3 has been pulled out far enough in the lateral direction from the suction anchor 1, and that the connecting element 3 has been pulled out sufficiently far in the direction along the longitudinal axis of the bore 9 of the locking element.

What is claimed is:

1. A method of placing a suction anchor with an attached anchor tether on the ocean bed, including lowering the suction anchor and securing the anchor by suction to the ocean bed, and thereafter connecting a lower end of the anchor tether to the suction anchor, the method comprising:

lowering the lower end of the anchor tether into a vertically extending guiding element with a lower locking element arranged thereto, the guiding and locking elements being positioned on the exterior of a side wall of the suction anchor and formed with a bore and arranged so that the longitudinal axes form an acute angle, the lower end of the anchor tether having a rod-like connecting element arranged thereto;

pulling an upper end of the connecting element outwards from the suction anchor so that the connecting element is generally brought into a position in which the longitudinal axis of the connecting element is concentric with the longitudinal axis of the bore of the locking element; and pulling the connecting element outwards from the suction anchor and toward the longitudinal axis of the bore of the locking element until a lower end of the connecting element engages the locking element of the suction anchor, the lower end of the connecting element being formed as a locking piece with a cross-sectional shape adapted to the bore of the locking element.

2. A method as defined in claim 1, wherein when the locking piece is lowered into the locking element, the connecting element is displaced sideways out from the suction anchor and into a slit formed in the guiding element, the locking element being formed with a guide surface for the locking piece.

3. A method as defined in claim 1, wherein when the upper end of the connecting element is pulled outwards from the suction anchor, the connecting element is torn through an end piece of a slit of the guiding element, the end piece being formed with a vertically extending rupture line.

4. A method as defined in claim 1, wherein when the upper end of the connection element is pulled outwards from the suction anchor, the locking piece is retained in the locking element, parts of the locking piece first bearing on the guide surface of the locking element and then on parts of the bore of the locking element.

5. A method as defined in claim 1, wherein a portion of the anchor tether is coiled up and fixed by lashing arranged to break into pieces on the occurrence of wave heave when connecting of the suction anchor and the anchor tether.

6. An assembly using a suction anchor with an anchor tether arranged to be placed on the ocean bed, wherein the suction anchor is lowered and secured by suction to the ocean bed, after which a lower end of the anchor tether is lowered and connected to the suction anchor, the assembly further comprising:

the suction anchor and the anchor tether being connected by a vertically extending guiding element with a lower locking element arranged thereto;

a rod-like connecting element adapted for insertion into the guiding and locking elements and for engagement with the locking element, in that the guiding and locking elements are positioned externally on the side wall of the suction anchor and formed with a bore each arranged so that their longitudinal axes form an acute angle; and the connecting element being positioned at the lower end of the anchor tether and formed with a lower locking piece, the locking piece having a cross-sectional shape adapted to the cross-sectional shape of the bore of the locking element.

7. An assembly as defined in claim 6, wherein the guiding element is formed with a vertically extending slit in connection with the bore, the slit of the guiding element being closed by means of an end piece on the side that faces away from the bore.

8. An assembly as defined in claim 7, wherein the end piece of the slit of the guiding element is formed with a vertically extending rupture line.

9. An assembly as defined in claim 6, wherein the locking element is formed with a recess adapted so that the locking piece of the connecting element may be passed from the bore of the guiding element and into the bore of the locking element, and which extends between the bores of the guiding and locking elements.

10. An assembly as defined in claim 9, wherein the locking element is formed with a guide surface adapted so that the connecting element may be displaced into the slit of the guiding element, and the locking piece is brought into engagement with the bore of the locking element, the guide surface being located in association with the recess and the bore of the locking element.

11. An assembly as defined in claim 6, wherein the connecting element is connected to the anchor tether by a shackle-like securing member.

12. An assembly as defined in claim 6, wherein a portion of the anchor tether is coiled up and fixed by a lashing, arranged so that it may break into pieces on the occurrence of wave heave during the connecting of the suction anchor and the anchor tether.

13. An assembly as defined in claim 6, wherein the anchor tether includes a chain.

14. A method of placing a suction anchor with an attached tether on the ocean bed, including lowering the suction anchor and securing the anchor by suction to the ocean bed, and thereafter connecting a lower end of the anchor tether to the suction anchor, the method comprising:

lowering the lower end of the anchor tether into a vertically extending guiding element with a lower locking element, the guiding and locking elements being formed with a bore and arranged so that the longitudinal axes form an acute angle, the lower end of the anchor tether having an elongate connecting element;

pulling an upper end of the connecting element outwards from the suction anchor so that the connecting element is brought into a position in which the longitudinal axis of the connecting element is generally concentric with the longitudinal axis of the locking element; and pulling the connecting element outwards from the suction anchor and toward the longitudinal axis of the bore of the locking element until the connecting element engages the locking element of the suction anchor, the connecting element including a locking piece with a cross-sectional shape adapted to the bore of the locking element.

15. A method as defined in claim 14, wherein when the locking piece is lowered into the locking element, the connecting element is displaced sideways out from the suction anchor and into a slit formed in the guiding element.

16. A method as defined in claim 15, wherein the locking element includes a guide surface for the locking piece.

17. A method as defined in claim 14, wherein when the upper end of the connecting element is pulled outwards from the suction anchor, the connecting element is torn through an end piece of a slit of the guiding element, the end piece being formed with a vertically extending rupture line.

18. A method as defined in claim 14, wherein when the upper end of the connection element is pulled outwards from the suction anchor, the locking piece is retained in the locking element, parts of the locking piece first bearing on the guide surface of the locking element and then on parts of the bore of the locking element.

19. A method as defined in claim 14, wherein a portion of the anchor tether is coiled up and fixed by lashing arranged to break into pieces on the occurrence of wave heave when connecting the suction anchor and the anchor tether.

* * * * *